US009554642B2

(12) United States Patent
Montabaur

(10) Patent No.: US 9,554,642 B2
(45) Date of Patent: Jan. 31, 2017

(54) POWER BRUSH

(75) Inventor: Werner Montabaur, Königswinter (DE)

(73) Assignee: MONTI-WERKZEUGE GMBH, Bonn (DE)

( * ) Notice: Subject to any disclaimer, the term of this patent is extended or adjusted under 35 U.S.C. 154(b) by 2943 days.

(21) Appl. No.: 11/603,915

(22) Filed: Nov. 22, 2006

(65) Prior Publication Data

US 2007/0209126 A1 Sep. 13, 2007

(30) Foreign Application Priority Data

Mar. 13, 2006 (EP) ..... 06005059

(51) Int. Cl.

| | |
|---|---|
| ***A46B 13/02*** | (2006.01) |
| ***A46B 13/00*** | (2006.01) |
| ***B24B 29/00*** | (2006.01) |
| ***B24D 13/10*** | (2006.01) |
| *B05D 3/12* | (2006.01) |

(52) U.S. Cl.

CPC ..... *A46B 13/001* (2013.01); *B24B 29/005* (2013.01); *B24D 13/10* (2013.01); *A46B 2200/3093* (2013.01); *B05D 3/12* (2013.01)

(58) Field of Classification Search

CPC . A46B 2200/3093; A46B 7/10; A46B 13/001; A46B 17/00; B24B 29/005; B24B 23/00; B24D 13/10

USPC ..... 15/21.1, 23

See application file for complete search history.

(56) References Cited

U.S. PATENT DOCUMENTS

| | | | | |
|---|---|---|---|---|
| 2,751,616 | A * | 6/1956 | Turner, Jr. et al. | 15/77 |
| 4,619,708 | A | 10/1986 | Bothner | |
| 5,386,608 | A * | 2/1995 | Montabaur et al. | 15/179 |
| 5,524,315 | A | 6/1996 | Montabaur | |

FOREIGN PATENT DOCUMENTS

| | | |
|---|---|---|
| DE | 88 00 781.2 | 3/1988 |
| JP | 2001334453 A * | 12/2001 |

OTHER PUBLICATIONS

Abstract of Japan, Publ.# 2001334453, Publ. date Apr. 12, 2001; Inventor Ono Shusuke, "Roughing Method and Device in Roughing Process of Decorative Laminated Sheet".

* cited by examiner

*Primary Examiner* — Shay Karls
(74) *Attorney, Agent, or Firm* — Andrew Wilford

(57) ABSTRACT

A power-brush apparatus has a housing and a brush rotatable on the housing about a brush axis and having bristles extending generally radially of the axis and having tips defining on rotation of the brush a circular orbit centered on the axis. The tips are engageable at a location with a workpiece surface. In accordance with the invention a blocking element is positioned radially inside the orbit immediately upstream from the location in a normal rotation direction of the brush. A drive rotates the brush in a working direction about the axis relative to the housing at a predetermined angular speed in the direction and thereby orbits the tips of the bristles about the axis such that the bristles engage the blocking element, are slowed thereby, and when released thereby snap back to accelerate forward and strike the workpiece at an augmented speed.

7 Claims, 2 Drawing Sheets

3
9
8
12
13
5
10
4
1
6
12
9
9
14
15
2

5'
8
3
9
5
1
R
10
6
18
13
9
17
14
15
9
19

Fig.3
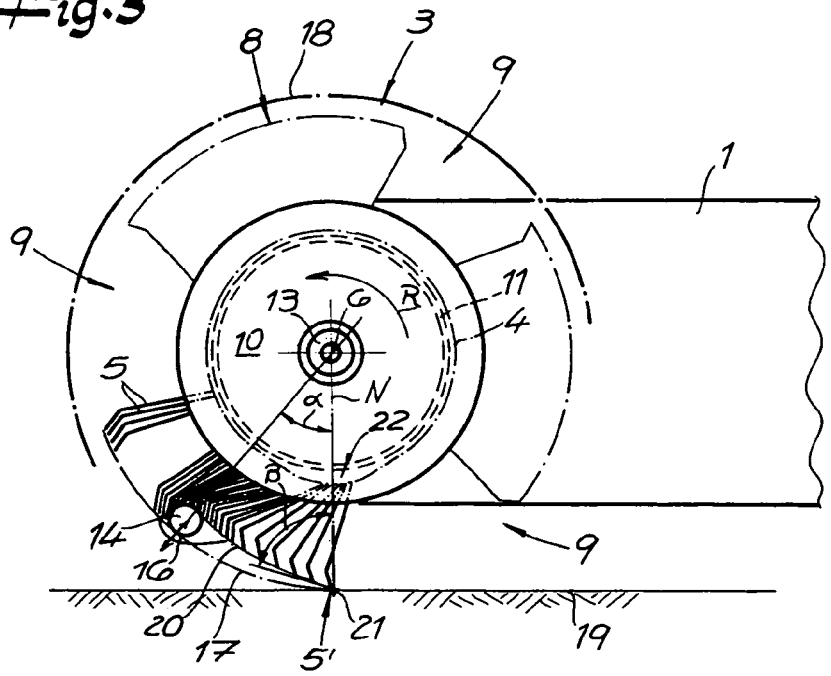
Fig.4A
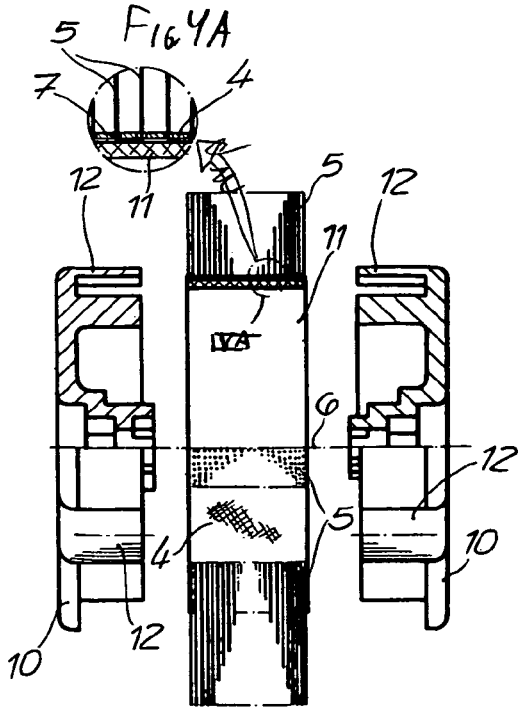
Fig.4
1
3

POWER BRUSH

FIELD OF THE INVENTION

The present invention relates to a power brush. More particularly this invention concerns such a brush used to remove paint, scale, or the like from a workpiece.

BACKGROUND OF THE INVENTION

A standard power brush has as disclosed in U.S. Pat. No. 5,524,315 an arbor that extends along an axis and that is rotated at high speed about the axis. A brush has a sleeve fitted to the arbor and a multiplicity of bristles that extend radially outward from the arbor. In use the brush is rotated at high speed while outer ends or tips of the bristles are pressed against a workpiece so as to strip paint, descale, deflash, roughen, or otherwise surface treat the workpiece. The bristles can be made of natural or synthetic fibers, or of metal. They are at least limitedly flexible and can be formed as wires, strands, or flat sheets extending generally in planes radially from the axis.

In commonly owned US 2005/0241085 a dressing device for provided for a power brush having a housing, a brush rotatable on the housing about a brush axis and having bristles extending generally radially of the axis, and a drive that rotates the brush in a working direction about the axis and thereby orbits tips of the bristles about the axis so in use the brush is rotated in this working direction. In this apparatus a support immediately adjacent the housing carries a rigid grinding wheel having an abrasive outer surface. This wheel is biased radially against the bristle tips to sharpen and clean them while a drive relatively displaces the bristle tips and the grinding-wheel surface while the wheel is urged against the bristle tips such that the grinding wheel surface primarily engages rear sides of the bristle tips turned away from the working direction. The wheel is provided upstream in the rotation direction of the from the region where the bristles contact the workpiece, typically offset by about 90° or more upstream. A similar system is shown in JP 2001334453 of Ono Shusuke.

The known brush assemblies have generally proved themselves, but are limited in case of treatment depths of 50 μm, 60 μm, but rarely more than 70 μm. To date such treatment depths can generally only be achieved by sand blasting. In fact, such treatment depths are required for preparing a workpiece surface for example prior to a coating process for subsequently assuring firm adherence of a coating. The described sand blasting however is limited due to environmental reasons, since the particles of the material that is separated from the workpiece gets mixed with the sand being used and formed with it hazardous waste requiring special disposal/treatment procedures. Moreover, sand blasting requires expensive machinery and additional safety measures for protecting adjacent surfaces that do not need to be abraded. This is time-consuming as well as expensive.

OBJECTS OF THE INVENTION

It is therefore an object of the present invention to provide an improved power-brush apparatus.

Another object is the provision of such an improved power-brush apparatus that overcomes the above-given disadvantages, in particular that can achieve treatment depths that are hitherto unattainable with the prior-art power brushes, so that the object is in effect to improve the effectiveness of a power brush.

Another object is an improved method of operating a power brush to improve its effectiveness, so that a bristle brush can achieve treatment depths comparable to sand blasting.

SUMMARY OF THE INVENTION

A power-brush apparatus has according to the invention a housing and a brush rotatable on the housing about a brush axis and having bristles extending generally radially of the axis and having tips defining on rotation of the brush a circular orbit centered on the axis. The tips are engageable at a location with a workpiece surface. In accordance with the invention a blocking element is positioned radially inside the orbit immediately upstream from the location in a normal rotation direction of the brush. A drive rotates the brush in a working direction about the axis relative to the housing at a predetermined angular speed in the direction and thereby orbits the tips of the bristles about the axis such that the bristles engage the blocking element, are slowed thereby, and when released thereby snap back to engage the workpiece surface at a greater peripheral speed than the angular speed.

With this system the blocking element, by slowing the bristles just before they contact the workpiece, stores energy in them that is effective when the bristles slide off the blocking element. The bristles snap back into their normal positions so that, when they hit the workpiece they are moving faster than they would normally move due to the constant angular speed of the brush.

To vary this acceleration effect, the blocking element is radially adjustable and only dips into the brush when needed, but otherwise, e.g. for normal- or light-duty abrasion, is outside the orbit so that the bristles move unimpeded by anything except the workpiece.

As long as the blocking element engages the bristles and temporarily reduces the speed of the bristles, in this process kinetic energy is stored in the bristles and/or the circular brush in total. This is due to the fact that the blocking element is, unlike the rotating bristles and the circular brush, substantially stationary (but however can be adjusted in radial and/or axial direction if necessary). This way, the bristles that strike on the blocking element, are elastically deformed or change their angular position relative to the circular brush, so that in total, in this manner, kinetic energy is stored, that is, in the form of elastic deformation energy.

As soon as the bristles leave the blocking element because of having been further advanced relative to the stationary blocking element by the rotationally driven brush holder, the bristles are released from the blocking element and are then able to rapidly release the kinetic energy stored before in the bristles and/or the circular brush in total by additionally acting in a striking manner upon the workpiece surface in question.

In this manner, the workpiece surface that is normally abutting tangentially against the bristle ring is treated according to the invention not only in an abrasive manner by means of the bristles, but additionally also by the fact that the bristles impact on the workpiece surface in a striking manner. This substantially results from the fact that the bristles are deviated by the blocking element primarily from their radial position relative to the rotational center or rotational axis. Indeed, the bristles no longer assume an almost perpendicular position relative to the circular brush surface when passing the blocking element, but are constrained into an acute-angular position relative to the circular ring surface by the blocking element. After passing the blocking element, the bristles spring elastically back into their almost perpendicular position relative to the circular brush surface.

Of course, the bristles can also take a acute-angle position relative to the circular brush surface from the first that is different from the perpendicular position described above. Then the blocking element provides for the bristles being forced into another different angular position when passing. Mostly, the angle is reduced, so that of course in principle also an increase of the angle by passing over the blocking element is possible and is comprised by the invention. In either case, the blocking element provides for the angular orientation relative to the circular brush surface of the bristles being modified such that after passing the blocking element, they can spring elastically into their initial position and thus perform the desired higher-speed impacting of the workpiece surface.

During this springing back of the bristles, in particular from their acute-angle orientation relative to the circular brush surface into their perpendicular position that is relative thereto, the bristle tips of the bristles approximately form an arc of a circle that does not tangent the workpiece surface. Rather this arc of a circle encloses a small acute angle so that as a result the striking treatment of the bristles can be explained, since due to the fact that the bristle tips meet the workpiece surface not tangentially (or virtually parallel) but rather at an acute angle, an almost hammering effect is achieved. Therefore, it is of course important whether the brush tips are for example 90° offset and in this way, reinforce or if necessary diminish the hammering effect, according to requirements.

In total, the angle of impact of the bristle tips is variable and can be achieved in that the bristles reliably spring back after impacting the workpiece surface. This is required to achieve a hammering working on the workpiece surface and not a subsequent abrasive treatment, as the latter would again reduce the achieved depth of treatment. For optimizing this effect, the rotational speed of the brush assembly and/or the angle of impact must be varied. Of course, also the hardness of the surface of the material that is to be treated plays an important role.

As a consequence thereof, the invention achieves treatment depths on the workpiece surface that until the present day only could be achieved by sand blasting treatment. Indeed, treatment depths of more than 50 μm, in particular more than 60 μm and preferably even those of more than 70 or 75 μm up to more than 100 μm have been observed. These treatment depths are so-called average roughness values (symbol Ra as arithmetic average value of the absolute values of profile difference within a reference position; see DIN 4764 as well as DIN ISO 1302). This data concerning the treatment depths relates to surfaces of unalloyed steel as workpiece and here in particular those of the type ST 37.

Preferably, the blocking element can engage into the bristle ring in a predetermined angle position. It is advantageous if the blocking element-forms an angle in the range of 10° to 70°, in particular 20° to 60° and preferably 25° to 45°. Moreover, the blocking element can be part of and/or be connected to a machine housing of a power brush and/or of the protective cap or shield thereof.

Generally, the blocking element however is an assembly that is independent of the power brush itself, in most cases a bolt having a cylindrical shape. The blocking element preferably engages radially into the bristle ring so far that an outermost edge surface of the cylindrical blocking element and the bristle ring approximately coincide. Due to this fact, the protective cap can maintain its existing and predetermined spacing outward of the bristle ring and in particular, no adaptations are required if the blocking element is employed. As a result the brush assembly according to the invention is suitable for retrofitting to an existing power brush.

Advantageously according to the invention the blocking element is connected to a machine housing of the power brush that houses the brush assembly. This can be achieved by a bracket or other formation.

Normally, the circular brush comprises a brush strip carrying the bristles and from which they project. This brush strip ensures that the bristles can deflect to the described acute-angle position relative to the workpiece surface from their mostly perpendicular position relative to the circular brush surface or respectively brush strip surface without any problem and that this way the kinetic energy is stored in a mostly elastic manner in the brush strip.

The brush holder generally is provided with a spacer sleeve that maintains two front disks at an axial distance from each other. The spacer sleeve carries the brush strip. However, it is also possible to work without a spacer sleeve. Then the circular brush strip simultaneously takes the function of the spacer sleeve. Finally, it has been found to be advantageous if the bristles have bristle tips that are bent forward in their rotational travel direction, so that the described striking effect of the bristles or the bristle tips is reinforced, because they meet the workpiece surface almost perpendicular and generate the described hammering effect.

With the apparatus and method of this invention one can achieve results only achieved in the past by the messier operation of sand blasting. This is achieved with the invention by the blocking element that engages into the rotating brush ring.

A further advantage is that the brushes do not have to be re-sharpened at their brush tips, but rather a substantially constant depth of roughness during the total of the service life of the circular brush is observed. This can be applied to a multitude of different bristles that can be employed according to the invention. However, in case the depth of roughness has to be increased, it is recommended to re-sharpen the bristles, since it has been found that such re-sharpening increases the depth of roughness by at least 20% or even more. To do this re-sharpening, the invention works advantageously with an abrasive stone and a comparable abrasive wheel as described in above-mentioned US patent publication '085.

The design can be such that different rotational directions of the brush assembly for the abrading-on the one hand and on the other hand for the sharpening. In the one rotational direction, the blocking element can enter the bristle ring, whereas in the other rotational direction the abrasive wheel engages the bristle tips either alternatively or additionally. In respect thereto, it is also possible to couple the setting and advancing of the abrasive wheel and the switching on and off of the other rotational direction for sharpening.

As bristles, the invention can for example employ U-shaped bristles that are inserted into the brush strip and anchored therein. It is however also in the scope of the invention to employ other materials, for example plastic, for the bristles. Material combinations can of course be employed.

Thus, it is possible to work for example with plastic bristles that are provided at their tips with metal balls or comparable impact tools, e.g. of stone. Herein, in particular plastics such as polyethylene, polytetrafluoroethylene and even polypropylene have been found to be effective.

As a result of the oscillating movement of the bristles caused by the blocking element, the related inclined position of the bristles and their springing back, the seats in the brush strip are elastically stretched so as to reinforce the described striking effect of the brush tips upon the workpiece surface. As far as necessary, the blocking element that reduces the speed of the bristles can be cooled. It is for example also possible that the blocking element is made hollow so it can be through-flowed by cooling air or the brush coolant is used to cool it also. In addition thermoelectric effects achieved by for example embedding a Peltier element can be used advantageously for cooling of the blocking element.

As driving element for the brush assembly, the invention proposes the use of any suitable driving motor, for example those that work pneumatically, but also electric motors, internal combustion motors, etc. Furthermore, it has been shown that use of the blocking element achieves depth of treatment can be increased by clearly more than 30% compared to the depth of treatment without a blocking element. Even values of up to 50% and more are possible. Comparable increase rates in the depth of treatment can be observed if in addition the bristle tips are sharpened regularly. Consequently, a brush assembly in total or a power brush is provided that is capable of roughening surfaces of materials as effectively as a sand blaster.

Further it has been shown that the number of bristles per surface unit in comparison to known circular brushes can be reduced. Thus, also the friction on the blocking element is reduced without modification of the above-mentioned efficiency-increase rates for the treatment depths. In this manner, the driving of the blocking element is not loaded exceedingly and in total, no heat problems or overheating respectively occur on the blocking element that are due to increased friction. Indeed, at this place a maximum of 16 bristles per $cm^2$ have been found to be favorable, arranged in several clusters about the brush core. In addition, in total four gaps between the individual spaces along the perimeter of the circular brush. Of course, also more interruptions are possible and are covered by the invention. Also, in principle also only three or two interruptions or even no interruption are possible.

BRIEF DESCRIPTION OF THE DRAWING

The above and other objects, features, and advantages will become more readily apparent from the following description, reference being made to the accompanying drawing in which:

FIG. 3 is another side view;

FIG. 4 is an exploded sectional end view of the brush assembly; and

FIG. 4A is a large-scale view of the detail indicated at IVA in FIG. 4.

SPECIFIC DESCRIPTION

Figure 1:
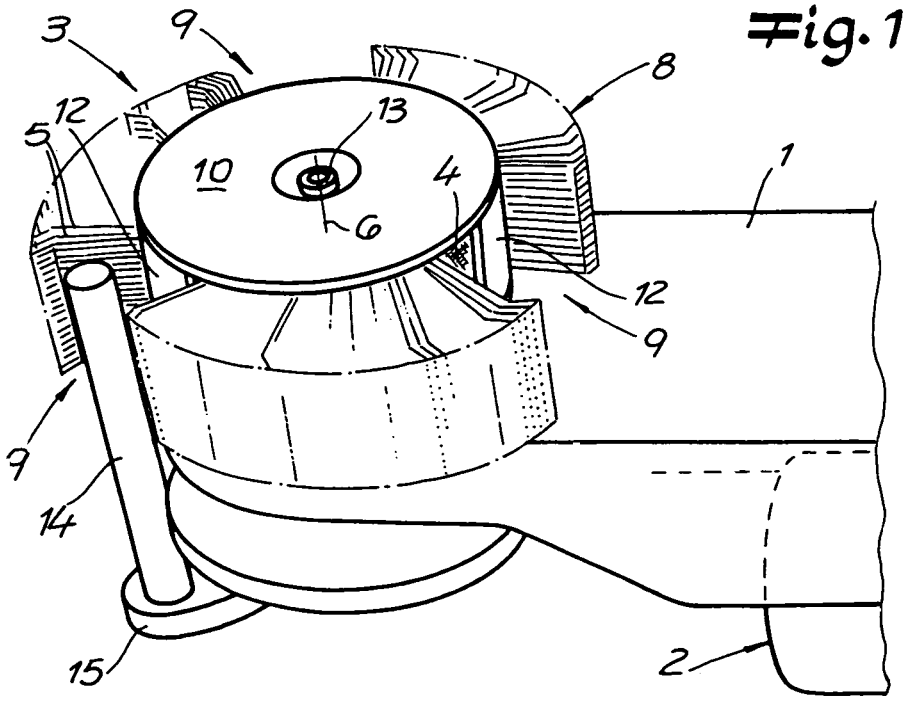
FIG. 1 is a perspective view of the power-brush apparatus according to the invention.

As seen in FIG. 1, a power brush has a housing 1 and a drive motor 2 for a brush 3 comprised of a core sleeve 4 centered on an axis 6 and provided with radially projecting bristles 5. During normal operation outer tips 5' of the bristles 5 lie on a cylindrical orbit 8 centered on the axis 6, and in fact these tips 5' are bent slightly forward into a rotation direction R. In practice two bristles 5 form part of a U-shaped steel wire that fits through a pair of radially throughgoing holes 7 (FIG. 4A) in the sleeve 4. Here the bristles 3 are formed into three angularly equispaced groups separated by gaps 9 with no bristles 5. They are provided a density of 14 to 16 bristles/$cm^2$.

The circular brush 3 is supported in the housing by a brush holder comprised of two axially spaced disks 10 flanking a cylindrical core sleeve 11 (see FIG. 4). The disks 10 have axially extending tabs or webs 12 that fit into the gaps 9 so as to ensure good rotational coupling of the brush 3 to the disks 10. The disk 10 and core 11 forming the holder are carried on a shaft 13 defining the axis 6 and coupled by unillustrated means to the drive motor 2 for rotation in the direction R. The spacer sleeve 11 is not needed when the core 4 of the brush 3 is stiff enough.

According to the invention a blocking element 14 is provided in the path of the bristles 5, that is radially inward of the orbit 8 and outward of the axis 6. Here the blocking element 14 is a cylindrical rod extending parallel to the axis 6 and carried on the outer end of an arm or bracket 15 secured on the machine housing 1 of the power brush. The length of the blocking element 14 is such that it substantially corresponds to the width or axial dimension of the brush core 4, so that the blocking element 14 does not stick axially past the circular brush 3.

The blocking element 14 is disposed stationary relative to the rotating circular brush 3 but can for example be adjusted radially thus dip into the bristles 5 within the bristle ring 8 or emerge therefrom. Furthermore, the blocking element 14 can of course also be adjusted axially, which however is not represented. Moreover, the blocking element 14 can be provided with unillustrated cooling means.

It can be seen that the blocking element 14 projects radially into the bristle ring 8 so far that an outer surface 16 of the blocking element 14 and an outer surface 17 of the bristle ring 8 approximately coincide. A protective cap or shield 18 extends radially outward past the orbit 8 over around 270° of the orbit 8, leaving a portion exposed for contacting the bristles 5 with the workpiece 19. The blocking element 14 is in this gap in the shield 18. Thus there is no need to modify the standard machine housing 1 to retrofit it with the blocking element 14 of this invention. The blocking element 14 is spaced upstream, (relative to rotation direction R) from the region of contact of the bristles 5 with the workpiece 19 by an angle $\alpha$, which here is between 30° and 40°. Of course the blocking element 14 can also be a part of the machine housing 1 or of the protective cap 18 of the power brush.

With the system of this invention the bristles 5 not only work the surface of the material 19 by scratching the tips 5' across the workpiece purely at the angular speed they assume as the result of rotation of the brush 3 about the axis 6. This effect is achieved in that the blocking element 14 engages the bristles 5 somewhat before they would normally strike the workpiece and bends them elastically back through an angle $\beta$ to a line N extending radially of the axis 6, then releases them so that they spring axially forward through an arc 20, which is not concentric with the circle 8, with their tips 5' moving at a speed that is equal to the speed at which they spring elastically back added to the rotation speed of the brush 3. The bristle tips 5' are therefore moving at a higher speed than the angular speed they would have over a short arc as they engage the workpiece. Thus, in effect a higher brush speed is achieved at only the critical area where the brush engages the workpiece 19, not around the entire periphery of the brush 3. The bristles 5 therefore work like tiny hammers when they strike the workpiece 19.

Figure 2:
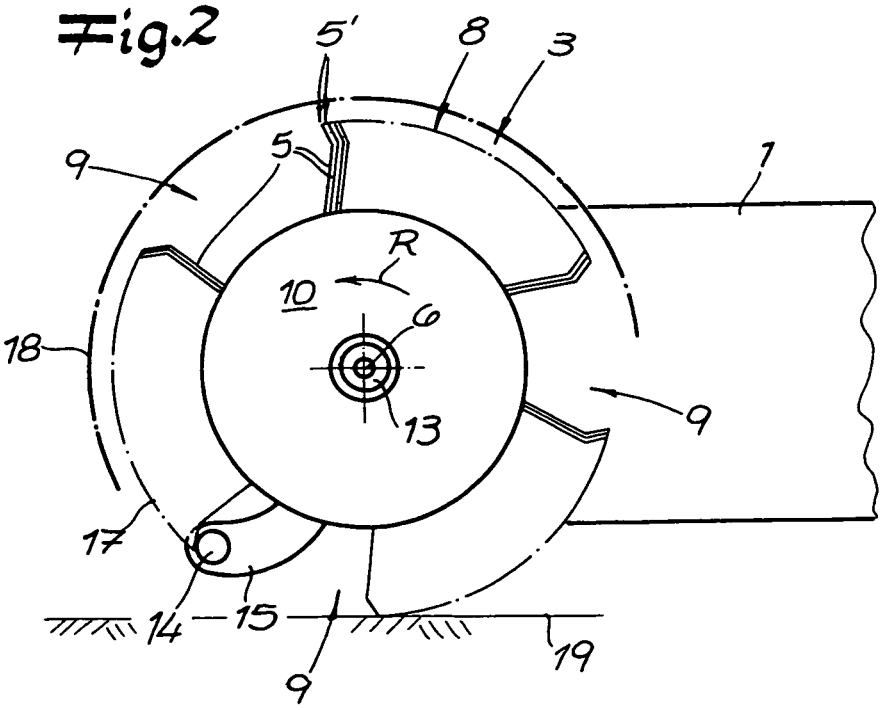
FIG. 2 is a largely schematic side view of the power brush.

The bristles 5 freed from the blocking element 14 form a right angle at a contact point 21 with the surface of the workpiece 19, which is a surface extending tangentially to the outer surface 17 of the bristle ring 8. Since the circular arc 20 along which by the bristle tips 5' move when released by the blocking element 14 is different from the outer surface 17 of the bristle ring, the angle β which is enclosed between the arc of a circle 20 and the normal line N is less than 90°. As a consequence, the bristle tips 5' meet the surface of the material 19 almost perpendicular in the region of the contact point 21 or respectively the related contact surface and moreover dispose of a speed component which is perpendicular to the surface of the material 19, as shown in FIGS. 2 and 3. After the bristles 5 come off the workpiece 19, they assume a position generally lying on respective radii to the axis 6.

The blocking element 14 shows the speed of the bristles briefly. After their release, the kinetic energy which has been stored due to this speed reduction in the circular brush 3 is released during a considerably shorter time interval and is used for the additional striking treatment of the surface of the material 19 by the bristles 5. Indeed, this kinetic energy is stored primarily in the brush strip 4, since it deviates from the cylindrical trajectory, as is in particular seen in the FIG. 3, where this deviation is marked with the reference number 22.

I claim:

1. A power-brush apparatus comprising:

a housing;

a brush rotatable on the housing about a brush axis in a working direction and having bristles made of steel wire, extending generally radially of the axis, and having tips defining on rotation of the brush a circular orbit centered on the axis, the tips being engageable at a location with a workpiece surface and each being bent forward relative to the respective bristle in the working direction;

a blocking element fixed relative to the housing and positioned radially inside the orbit immediately upstream between 25° and 45° relative to the axis and to the working direction of the brush from the location; and drive means for rotating the brush in a working direction about the axis relative to the housing at a predetermined angular speed in the direction and thereby orbiting the tips of the bristles about the axis such that the bristles engage the blocking element, are slowed thereby, and when released thereby snap back to engage the workpiece surface at a greater peripheral speed than the angular speed with the bent-forward bristle tips striking and hammering the workpiece surface generally perpendicularly at the location.

2. The power-brush apparatus defined in claim 1 wherein the blocking element is fixed on the housing.

3. The power-brush apparatus defined in claim 2 wherein the blocking element has a radial outermost edge generally lying on the orbit.

4. The power-brush apparatus defined in claim 1 wherein the brush comprises a core sleeve from which the bristles extend.

5. The power-brush apparatus defined in claim 4, further comprising:

a pair of axially spaced holder disks flanking the core sleeve, rotatable about the axis on the housing, and connected to the drive means.

6. The power-brush apparatus defined in claim 1 wherein the bristles are provided at density of at most 16 bristles per $cm^2$.

7. A method of abrading a workpiece, the method comprising the steps of:

rotating a brush on a housing about an axis in a direction at a predetermined angular speed such that bent-forward tips of bristles made of steel wire extending generally radially of the axis define a circular orbit centered on the axis;

engaging the tips radially at a location with a workpiece surface to abrade the surface at the location; and positioning a blocking element fixedly relative to the housing and radially inside the orbit upstream 25° to 45° relative to the axis and to the direction from the location and thereby temporarily slowing angular movement of the bristle tips such that when released they snap back to engage the workpiece surface at a greater peripheral speed than the angular speed and with the tips striking and hammering the workpiece surface generally perpendicularly at the location.

* * * * *